United States Patent [19]

Parish

[11] Patent Number: 4,655,008

[45] Date of Patent: Apr. 7, 1987

[54] INFLATABLE SHELTER LIFT BAG

[75] Inventor: James M. Parish, Wadsworth, Ohio

[73] Assignee: The B. F. Goodrich Company, Akron, Ohio

[21] Appl. No.: 811,071

[22] Filed: Dec. 19, 1985

[51] Int. Cl.[4] ..... E04B 1/34

[52] U.S. Cl. ..... 52/2; 254/93 HP

[58] Field of Search ..... 52/2, 3, 114, 741; 135/103, 96, 97; 254/93 HP, DIG. 1; 137/226, 512.1; 92/34, 37, 38

[56] References Cited

U.S. PATENT DOCUMENTS

| | | | |
|---|---|---|---|
| 4,061,310 | 12/1977 | Vetter | 254/93 HP |
| 4,560,145 | 12/1985 | Widmer | 254/93 HP |

FOREIGN PATENT DOCUMENTS

| | | | |
|---|---|---|---|
| 2628029 | 12/1977 | Fed. Rep. of Germany | 254/93 HP |
| 1072884 | 6/1967 | United Kingdom | 254/93 HP |
| 380811 | 8/1973 | U.S.S.R. | 52/2 |
| 509700 | 6/1976 | U.S.S.R. | 52/2 |
| 625079 | 9/1978 | U.S.S.R. | 254/93 HP |

*Primary Examiner*—Carl D. Friedman
*Assistant Examiner*—Naoko N. Slack
*Attorney, Agent, or Firm*—Joseph Januszkiewicz

[57] ABSTRACT

A lift tube for use in erecting a shelter that has an air inflatable section or sections which are raised into position with the aid of an inflatable lift tube composed of a plurality of compartments that are interconnected in seriatim order. Bulk-heads in the lift tube separate such compartments and have one way valves to be done in seriatim order to control the inflation action.

17 Claims, 10 Drawing Figures

FIG. 1
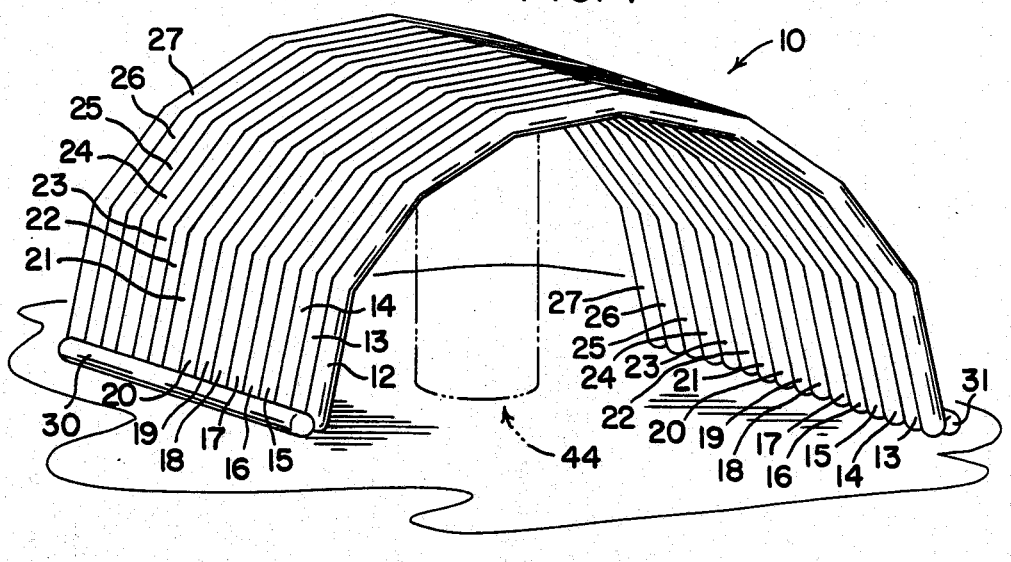
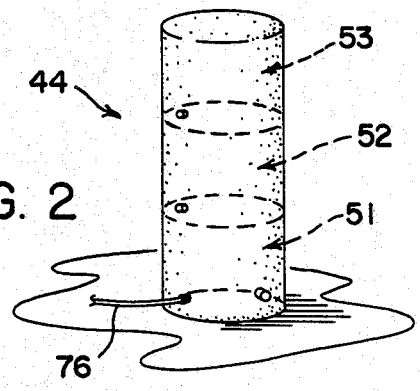
FIG. 2
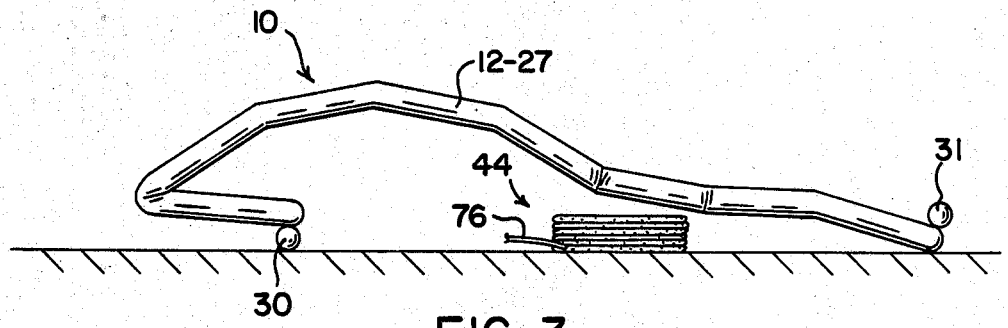
FIG. 3

INFLATABLE SHELTER LIFT BAG

BACKGROUND OF THE INVENTION

This invention relates to inflatable structures and to the method of inflating such shelter.

The inflatable shelter of the present invention is formed of a plurality of modular sections wherein the number of sections used may be increased or decreased to make a complete shelter. Heretofore, inflatable buildings or shelters utilized a canopy of flexible impermeable material which was shaped so that it could be supported solely by internal air pressure. Such structures required a fully enclosed or encapsulated canopy to prevent any leakage of excessive air around its periphery. These types of inflatable shelters require extensive ground preparation but then are easily raised by the internal pressure, however, their continued on-site use requires a continued new supply of pressurized air. The inflatable shelter of the present invention requires minimal ground preparation and the larger sizes require manpower to erect, however, with the assist of an auxiliary inflatable jack or lift tube, the erection of a self-supporting, inflatable shelter is easier to perform and in the longer term use is superior to prior inflatable structures. With the use of the inflatable auxiliary jack, the air inflatable shelter of the present invention is cost effective in its use and application thereby increasing the versatility of its use.

SUMMARY OF THE INVENTION

The present invention contemplates the use of a self sustaining inflatable shelter that is composed of sections that once inflated do not need a new supply of air wherein each section is composed of a plurality of inflatable arched tubes which may be easily erected by an inflatable lift tube which is composed of a plurality of inflatable chambers. Such chambers in the lift tube are inflated in a seriatim order to assure proper deployment of the interconnected arched tubes and the flexible attached cover with or without end flaps which can be attached mid-way through the erection process. The novelty of the present invention resides in the fact that the lift tube has a smaller diameter relative to its overall length and is able to provide the lifting of a substantial load without buckling or kinking in a cost effective manner.

BRIEF DESCRIPTION OF THE DRAWINGS

FIG. 1 is a schematic perspective front elevational view of an inflatable shelter showing an inflatable lift tube in phantom lines;

FIG. 2 is a perspective view of the inflatable lift tube fully deployed;

FIG. 3 is a schematic front elevational view of the inflatable shelter being raised with the lift tube in position for deployment;

DETAILED DESCRIPTION

Figure 4:
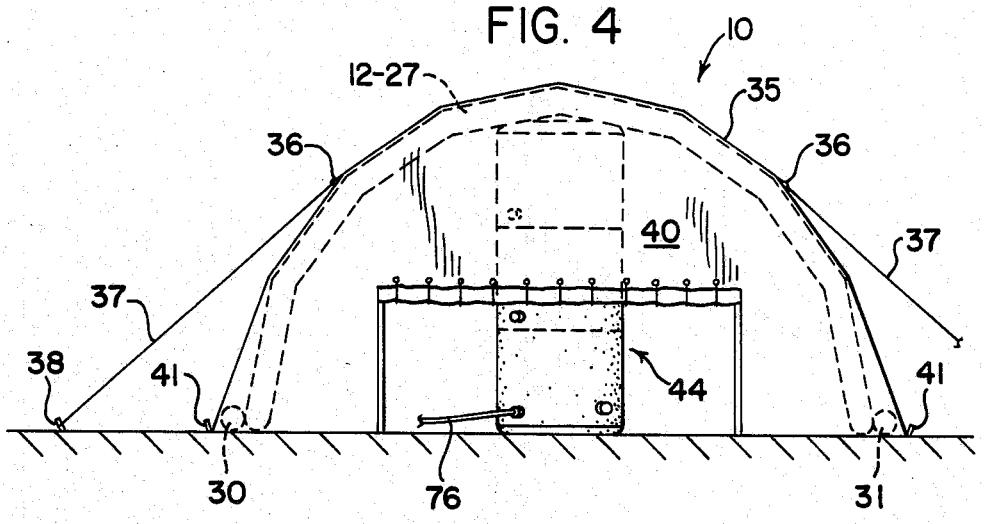
FIG. 4 is a schematic front elevational view of the inflatable shelter fully raised by the inflated lift tube.

Referring to the drawings wherein like reference numerals designate like and corresponding parts throughout the several views, there is shown in FIGS. 1 and 3 an inflatable shelter having a single section 10 composed of a plurality of arched inflatable tubes 12 through 27. Each of these inflatable tubes are individual curved or arched tubes circular in cross section. Although only one shelter section is disclosed, additional inflatable sections may be attached to either end of the shelter section shown. For clarity, only one shelter section is shown with a single lift tube to be described for the erection of such shelter section 10. The arched tubes 12 through 27 as illustrated in FIGS. 1 and 3 can be a series of interconnected linear portions defining a series of arched tubes. The series of tubes 12 through 27 are arranged and suitably held in abutting relationship as by suitable tabs cemented to adjacent tubes along linear spaced positions.

Alternate tubes 12, 14, 16, 18, 20, 22, 24 and 26 are connected at their lowermost portion to a manifold tube 30 while alternate tubes 13, 15, 17, 19, 21, 23, 25 and 27 are connected at their lowermost portion to a manifold tube 31. A cover can be suitably attached to such described shelter section 10. Suitable pressurizing means are provided to pressurize the respective manifold tubes 30 and 31 and their corresponding arched tubes 12 through 27 are alternatively suitable inlet fittings and relief valves may be installed on arched tubes 12 and 13 to provide the means for inflating and deflating tubes 12 and 13 as well as the other tubes 14 through 27 via their connection to the manifold tubes 30 and 31.

While the tubes 12 through 27 in section 10 are in a deflated condition, a cover 35 (FIG. 4) of water resistant material is placed over the section 10. The cover 35 is secured to section 10 via suitable grommets along the edges thereof. The cover 35 also has a plurality of loop patches 36 (FIG. 4) along the respective sides which receive ropes 37 whose other end has a loop which provides a means for securing such end to a stake 38 that is driven into the ground.

A front end panel 40 (FIG. 4) is suitably secured to section 10 along arched tube 12 as by a plurality of loops suitably sewn on cover 35 along the upper outer periphery as viewed in FIG. 4, which in turn are suitably connected to grommets on tube 12. Suitable access flaps may be cut into the end panel 40 to provide access into and out of the shelter. A suitable end panel with a flap may be secured in a similar manner to the other end of section 10 as on arched tube 27 to provide a fully enclosed shelter. The cover 35 for shelter 10 may be anchored to the ground by providing longitudinally spaced loop patches along the peripheral side edges of the cover and thence securing the section to the ground via stakes 41 which pass through the loops.

Figure 5:
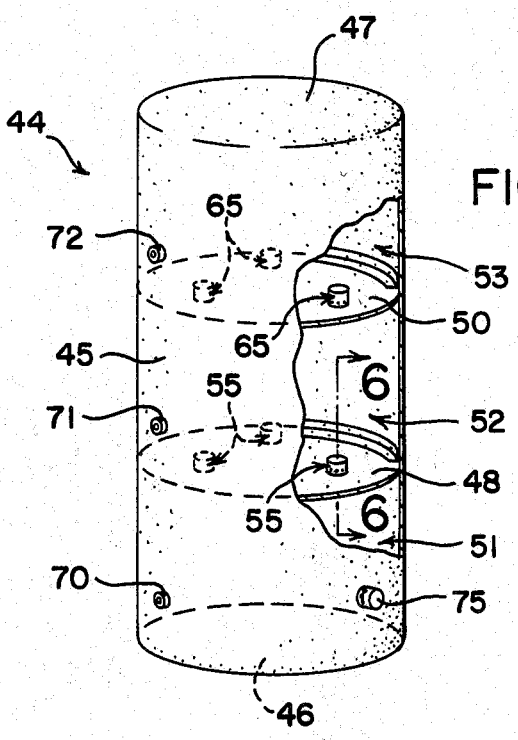
FIG. 5 is an enlarged perspective view of the inflated lift tube with a portion broken away to show the bulkheads separating the lift tube into different chambers.
Figure 6:
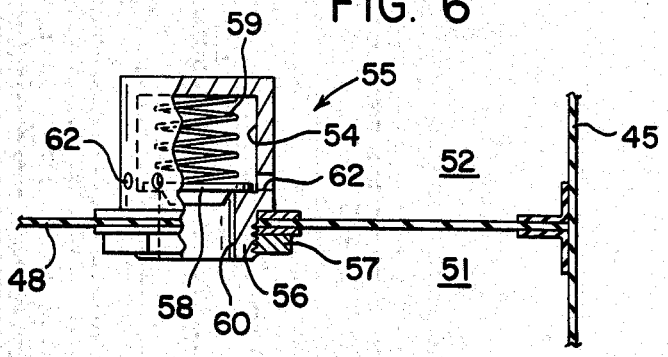
FIG. 6 is a front elevational view of a one-way valve partly in cross section attached to a bulkhead between chambers taken on line 6—6 of FIG. 5.

The lift tube 44 as seen in FIGS. 2 and 5 is an accordian-like folded tube having a one-piece air impermeable cylindrical shaped fabric panel 45 joined to a lower circular air impermeable panel 46 and to an upper circular air impermeable panel 47. Suitably connected to the inner periphery of the cylindrically shaped fabric 45 are a pair of spaced bulk-heads 48 and 50 separating the interior of such lift tube 44 into three compartments or chambers 51, 52 and 53. The invention is equally applicable to a lift tube having but one bulkhead, however, the invention as described relates to a three chambered pneumatic jack utilizing two bulkheads providing superior lifting performance.

A plurality of relief valves 55 are mounted on bulkhead 48 to interconnect chamber 51 with chamber 52. All of such relief valves 55 are identical in structure and only one will be described.

Relief valve 55 has a lower threaded portion 56 that is cooperative with a threaded nut 57 to secure such valve 55 to the bulk-head 48. Relief valve 55 has a central bore 54 which houses a flat cylindrical washer or valve seat 58 biased via a spring 59 to cover bore 60 in the lower portion of relief valve 55 which would otherwise communicate with the central bore 54 and a plurality of circumferentially spaced ports 62 in the lower side portion of relief valve 55. Whenever the pressure difference in chamber 51 and 52 reaches a pre-set pressure, which in the instant case is 0.2 psi, or higher, valve seat 58 will interconnect chamber 51 with chamber 52 whereby chamber 52 is pressurized via bore 60, bore 54 and ports 62.

Figure 8:
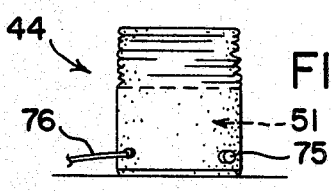
FIG. 8 is a front elevational view of the left tube showing its first lower chamber inflated with the remaining portion of the lift tube in accordian-like folded condition.
Figure 9:
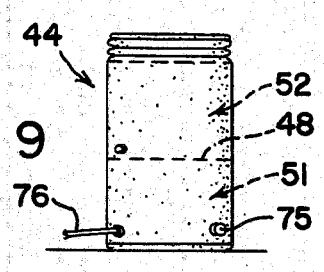
FIG. 9 is a front elevational view of the lift tube showing the lower two chambers inflated with the remaining one chamber in deflated condition as illustrated by the accordian-like folder condition of the upper tube portion.
Figure 10:
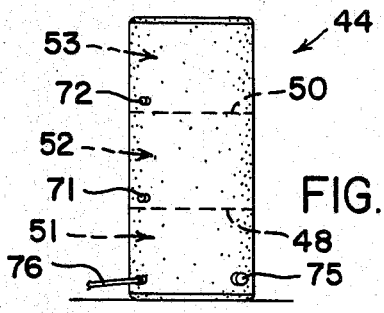
FIG. 10 is a front elevational view of the lift tube with all three chambers fully inflated.

A plurality of relief valves 65 are mounted on bulkhead 50 to interconnect chamber 52 with chamber 53. Relief valves 65 are identical in construction to relief valves 55 previously described. In order to exhaust the respective chambers 51, 52 or 53, each chamber is connected to atmosphere via a dump valve 70, 71 and 72, respectively. Such dump valves are manually operable to deflate such chambers to facilitate the removal of such lift tube from the shelter and for its subsequent use and storage. The dump valve 70, which is mounted on cylindrical shaped fabric panel 45, will also be used for inflating chamber 51 initially as well as the other chambers 52 and 53 from a suitable pressure source via conduit 76 (FIGS. 8–10). Chamber 51 has an additional relief valve 75 which is mounted on cylindrical shaped fabric 45 and is similar to the bulkhead relief valves 55 and 56. Relief valve 75 is set to a higher pressure than the pressure the bulk-head relief valves 55 or 65 are set at times the number of chambers, but lower than the burst pressure of the material for the lift tube as a safety feature and on actuation vents to atmosphere the excessive pressure. In this case, the pressure must be greater than 0.2 psi$\times$3 chambers=0.6 psi. All chambers can be fitted with relief valves if desired.

The amount of load that can be lifted by this invention is equal to the pressure in the last chamber$\times$the area of the tube's cross section. For a 6 ft. diameter tube, and a 0.2 psi pressure, the lifting force=0.2 psi$\times$4072 in$^2$=814 lbs.

Initially, the uninflated shelter section or sections 10 are laid flat on the ground with the cover 35 being secured to the shelter section along the edges. The respective ropes 37 that are secured to the sides of the cover 35 are stretched outwardly away from the center of the cover. Stakes 41 are then used to anchor the perimeter of the cover to the ground either as a temporary measure or spaced such as to assure the erectors that the distance between the manifold tubes 30 and 31 are the same as the final spacing desired. The front end panel 40 and the cover 35 are omitted from the arched tubes as illustrated in FIGS. 1 and 3 to more clearly depict the arrangement of the arched tubes relative to the lift tube 44. The arched tubes 12 through 27 are then inflated partially to lift the arched tubes sufficiently off the ground to permit the placement of the lift tube 44 under the shelter section 10 as depicted schematically by FIG. 3. As seen therein, lift tube 44 is in a completely deflated condition and accordian pleated into a compact package that can be easily positioned.

Figure 7:
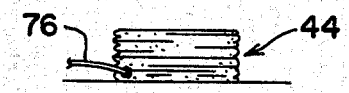
FIG. 7 is a front elevational view of the lift tube in a fully deflated condition.

The lift tube 44 is connected via conduit 76 to a suitable pressure source which pressurizes the lowermost chamber 51 causing the lift tube to be stretched vertically upwardly in a straight line as depicted by FIGS. 7 and 8 such that the upper portion of the lift tube that contains chambers 52 and 53 remain in an accordian pleated folded condition. Under this condition of inflation, the lift tube would make contact with the shelter section 10 and effect a slight lifting of the central portion of the shelter section. Chamber 51 is continued to be pressurized until the pressure therein reaches approximately 0.2 psi at which point relief valves 55 on bulkhead 48 communicate chamber 51 with 52 so that the additional pressurization of chamber 51 will pressurize chamber 52 and continue to lift the central portion of the shelter section 10. The difference in pressure between chambers 51 and 52 will be maintained at approximately 0.2 psi by the relief valve. As soon as the second chamber 52 reaches its pre-set pressure, which in the example depicted is 0.2 psi, chamber 51 will reach approximately 0.4 psi, the relief valves 65 in bulk-head 50 opens up and communicates chamber 52 with the third chamber 53 which will then be pressurized. Pressurization will be continued until all chambers 51, 52 and 53 are pressurized to position the shelter section 10 into the position shown in FIGS. 1 and 4 with the lift tube 44 being in the fully inflated and distended condition as depicted by FIGS. 10 and 5. In this condition chamber 51 will reach approximately 0.6 psi, while chamber 52 reaches 0.4 psi and chamber 53 reaches 0.2 psi. If pressurized air continues to enter the lift tube 44 with all chambers pressurized, the relief or dump valve 75 in the first chamber 51 will relieve excess air to the atmosphere depending on its setting to prevent the lift tube from bursting. The arched tubes 12 through 27 are then fully inflated to the desired pre-set pressure. Any adjustments to the stakes 41 and 38 as well as cover 35 can be made, after which the respective dump valves 70, 71 and 72 are actuated to fully deflate such lift tube and for removal from the shelter section 10. The lift tube may be deflated by actuation of the three dump valves 70, 71 and 72. The other manner of inflating the lift tube is to actuate and pressurize chamber 53, thence chamber 52 followed by pressurization of chamber 51. In this instance, the conduit 76 would be connected first to valve 72, thence valve 71 followed by valve 70. The lift tube has been described as used in erecting a shelter, however, such lift tube may be used in lifting other devices such as use as a pneumatic jack in lifting a car to change a tire. Another modification is to use in the first described embodiment orifices in lieu of the valves 55 and 65.

Various modifications are contemplated and may obviously be resorted to by those skilled in the art without departing from the described invention, as hereinafter defined by the appended claims.

I claim:

1. An inflatable lift tube for use in erecting an inflatable shelter comprising an elongated air impermeable bag that has an upper panel and a bottom panel, said bag having a bulk-head for separating the interior of said bag into compartments, said bulk-head having relief valve means for communicating one of said compartments upon reaching a preset pressure with another one of said compartments, and inlet valve means operatively connected to said one compartment for effecting initial inflation on said one compartment from a pressure source followed by pressurization of said other one of said compartments through said relief valve means in said bulk-head for effecting the lifting of the center portion of an inflatable shelter.

2. An inflatable lift tube as set forth in claim 1 wherein said other one of said compartments has a dump relief valve for exhausting pressurized air therefrom, and said inlet valve means operates as a dump valve for said one compartment.

3. An inflatable lift tube as set forth in claim 2 wherein the ratio of the width of any one of said compartments to the overall length of said same lift tube is less than one.

4. An inflatable lift tube as set forth in claim 2 wherein said relief valves are air flow regulating valves mounted on said bulkhead for controlling the flow of pressurized air between said compartments.

5. An inflatable lift tube as set forth in claim 2 wherein the width of said lift tube is much smaller than the overall length of said lift tube.

6. An inflatable lift tube as set forth in claim 4 wherein said lift tube is a cylindrically shaped elongated member, and said upper and bottom panels are circular in shape.

7. An inflatable lift tube for use in erecting an inflatable shelter comprising an elongated air impermeable bag that has an upper panel and a bottom panel, said bag having at least a pair of bulk-heads for separating the interior of said bag into compartments with at least two of said compartments being spaced end compartments and an intermediately located compartment, each of said bulk-heads having relief valve means for communicating adjacent compartments upon reaching a preset pressure in one of said compartments, and inlet valve means operatively connected to one of said end compartments for effecting initial inflation on said one end compartment from a pressure source followed by pressurization of said intermediate compartment followed by the pressurization of the remaining one of said end compartments through said relief valve means for effecting lifting action on a portion of said shelter.

8. An inflatable lift tube as set forth in claim 7 wherein each of said compartments have a dump relief valve for exhausting pressurized air therefrom, and wherein said inlet valve is a dump valve.

9. An inflatable lift tube as set forth in claim 8 wherein said relief valves have the same actuating pressures.

10. An inflatable lift tube as set forth in claim 8 wherein said relief valves have different actuating pressures.

11. An inflatable lift tube as set forth in claim 9 wherein the width of said lift tube is substantially smaller than the overall length of said lift tube.

12. An inflatable lift tube for use in lifting a structure comprising an elongated air impermeable bag, said bag having a plurality of separate compartments formed by bulk-heads therebetween, an air flow regulating device mounted in each bulk-head to interconnect adjacent compartments upon a preset pressure attained in one of said compartments, said compartments arranged in seriatim order for inflation from one end of said elongated bag to the other end of said elongated bag, and air inlet means connected to one of said compartments adjacent said one end of said bag to provide a seriatim inflation of said compartments from said one end of said other end to provide a progressive inflation of said compartments and said lift tube.

13. An inflatable lift tube as set forth in claim 12 wherein said air flow regulating devices are one way relief valves.

14. An inflatable lift tube as set forth in claim 13 wherein the width of any one of said compartments is equal or greater than the length of said same compartment to provide a lifting action by said lift tube without buckling.

15. An inflatable lift tube as set forth in claim 14 wherein each of said compartments have a dump relief valve for exhausting air therefrom.

16. An inflatable lift tube as set forth in claim 15 wherein said relief valves have different actuating pressures with the valve for actuation being in decending order from said one end.

17. An inflatable lift tube as set forth in claim 15 wherein said relief valves have the same actuating pressures.

* * * * *